United States Patent [19]

Flesher

[11] 4,111,214

[45] Sep. 5, 1978

[54] WATER PIPE

[76] Inventor: Robert W. Flesher, 11007 Drumm Ave., Kensington, Md. 20795

[21] Appl. No.: 747,608

[22] Filed: Dec. 6, 1976

[51] Int. Cl.[2] ..... A24F 1/14; A24F 1/30

[52] U.S. Cl. ..... 131/173; 131/198 R

[58] Field of Search ..... 131/173, 198, 240

[56] References Cited

U.S. PATENT DOCUMENTS

| | | | |
|---|---|---|---|
| 1,967,438 | 7/1934 | Hartzes | 131/173 |
| 3,881,499 | 5/1975 | McFadden et al. | 131/173 |
| 3,882,875 | 5/1975 | Frost | 131/173 |
| 4,031,905 | 6/1977 | Dunn | 131/173 |

FOREIGN PATENT DOCUMENTS

| | | | |
|---|---|---|---|
| 394,679 | 6/1962 | Switzerland | 131/173 |

*Primary Examiner*—Stephen C. Pellegrino
*Attorney, Agent, or Firm*—John F. McClellan, Sr.

[57] ABSTRACT

A water pipe having a tubular body bent at an acute angle into "V" shape, the first leg of the "V" supported by a stand at a shallow angle to the horizontal with the "V" apex down, and the second leg above in a vertical plane. The first leg has a removable plug at the free end for introduction and removal of water and for cleaning, and a smoke inlet partway up the incline of the leg and near the top surface. Smoke is introduced from a smoke tube leading from a pipe bowl supported by the stand beyond and above the apex. The second leg of the "V" has a purge tube connecting at an inlet partway up the leg in the top surface and leading to a thumb-controllable purge vent in a handsaw-type grip in a wedge shaped brace tying the "V" legs together.

11 Claims, 8 Drawing Figures

WATER PIPE

This invention relates generally to smoking apparatus and specifically to water pipes.

A principal object of this invention is to provide an improved water pipe.

Webster's Seventh New Collegiate Dictionary, G. C. Merriam Company (1972) gives only one meaning for the term water pipe, and only one meaning for the term hookah:

"water pipe n: a tobacco smoking device so arranged that the smoke is drawn through water".

"hookah n—: a pipe for smoking that has a long flexible tube whereby the smoke is cooled by passing through water".

Volume 22 at page 267 of Encyclopoedia Brittanica (1966 Edition) gives the parts of the "water tobacco pipe":

"This consists of three pieces, the head or bowl, the water bottle or base and the snake or long flexible tube ending in the mouthpiece".

Volume 17 at page 1106 of the Encyclopoedia says:

"The practice of cooling and cleansing the smoke of a tobacco pipe by drawing it through water was not followed in the Americas nor has it been very popular among Europeans. The Bushmen and Hottentots of southern Africa used the *dakka* pipe, which cooled and mitigated the effects of hemp smoke by drawing it through a horn of water. While Africa continued to produce more orthodox pipes of almost every possible material and size, the water pipe spread to India (where a more elegant version is called the *nargileh*) and the Far East, and the hookah was popular among both men and women in Persia in the 17th century."

Whatever the cause for the delay, the water pipe appears now to be "followed" in America, and despite the long history of the device, to have been substantially improved by the present inventor.

Further objects of this invention are to provide a water pipe which provides better cooling through greater turbulence by forming a head of water by pressure of the smoke drawn in prior to intermixing of smoke with water in passage through the water, which has improved provision for charging with water and with ice, which is easily cleaned and inspected and observed during operation, and which is attractive in appearance.

Still further objects of the invention are to provide a water pipe as described which is handy, stable and convenient and spill-resistant in operation, which is adaptable by change in attitude to serve as a conventional pipe, to serve as a water pipe with relatively little water path for the smoke, and to serve as a water pipe with relatively long path for the smoke.

In brief summary given for purposes of cursive description only and not as limitation, the invention includes a water pipe with angle-tube smoke and water passage having connection at an apex, a pipe bowl having connection with an intermediate portion of the device and a purge provision.

The above and other objects and advantages of this invention will become more readily apparent upon examination of the following description, including the drawings in which like reference numerals refer to like parts:

STRUCTURE

Figure 1:
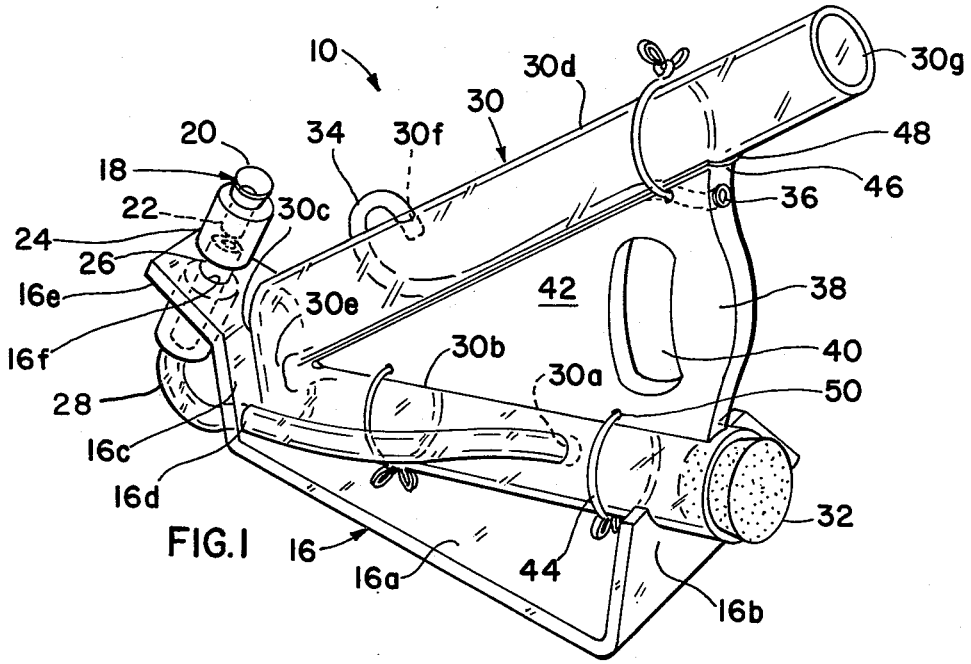
FIG. 1 is an isometric rear quarter view.

FIG. 1 illustrates the parts of the invention 10.

Stand 16 includes a flat base portion **16*a* upturned and notched at the rear forming a saddle 16*b*, and upturned at the front forming a forwardly sloped foot 16*c*. The foot has a first aperture 16*d* and terminates at the top in a forward incline 16*e* having a second aperture 16*f*. The stand is preferably of transparent plastic such as methylmethacrylate, Pipe bowl assembly 18 includes a metal bowl 20, which characteristically is small and has a perforate shank 22. Wooden sleeve 24 frictionally connects the shank and transparent plastic sleeve 26 which fits securely in the stand second aperture. Preferably transparent, flexible smoke-tubing 28, which may be of polyvinyl chloride connects with the plastic sleeve and extends through the stand first aperture to frictional connection in the wall of a combination flask-and-stem assembly or body 30**.

For convenience the body will be described in terms of an upper leg and a lower leg, but this is not to be construed as a limitation in operational capacity, since the invention can be operated in various orientations, including orientation with the legs equally disposed about a vertical axis.

Body 30 has a smoke intake aperture **30*a* receiving the bowl tubing in an overflow-preventing location about half the length of the upper portion of the wall of tubular first or lower leg 30*b*** which forms the lower half the body, which consists of preferably transparent rigid tubing, preferably of the same material as the stand, and bent into "V" configuration.

The lower leg extends at a shallow downward angle from an open end detachably plugged by a cork 32, past the supporting saddle of the stand, at which it has connection as by transparent cement, to integral connection at an apex **30*c* with the tubular upper leg or second tube 30*d*** of the body, which lies in a vertical plane above the lower leg.

The apex may advantageously have connective support at the foot **16*c* of the stand, preferably in the form of transparent cementing, and at the apex the lower leg bore connects with the upper leg bore through a preferably crimped, constricted passage 30*e*** or throat broader laterally than deep, in the form of a slot. When the tubing is bent and contoured flat to fit the stand foot, a portion can preferably be buckled inward at the rear to constrict the throat. Alternatively the assembly can be built up of separate parts cemented together, and the throat can be made with a fuller opening.

From the apex the upper leg extends up at an acute angle with the lower leg past a purging aperture **30*f* in the top of the upper leg about one-third the way up from the apex to an open mouthpiece end 30*g*, which has the full diameter of the tubing, preferably about 1½ inches (37 mm) inside, with ⅛ inch (3 mm) wall. The mouthpiece end opening is convenient for smoking when the unit is resting on a table. Purge-line flexible tubing or purge-tube 34, frictionally held, connects the purging aperture with a thumb-closable vent or tubing end 36 in handle grip 38 which is formed by opening 40 in the base of triangular brace 42 which fills the angle between the upper and lower legs and is connected to both legs by ties 44**. Preferably the handle curves outwardly at the base or rear to permit better manipulation of the unit for purposes which will be described.

The brace is preferably of wood such as polished mahogany and may have grooves 46 and a felt liner 48 between tubing and wood to prevent rocking and rattling. The ties may be of rawhide passed through appropriate holes 50 in the wood, and permit differential expansion and contraction between plastic and wood under the operating conditions to be described.

Figure 2:
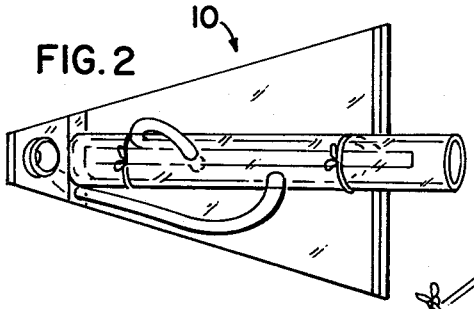
FIG. 2 is a top plan view.

FIG. 2 shows the generally triangular shape of the stand in plan view, broader at the rear, providing a stable base for the unit.

Figure 3:
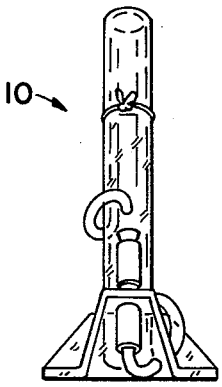
FIG. 3 is a front elevational view.
Figure 4:
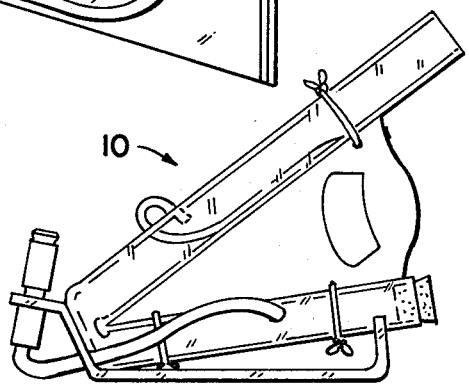
FIG. 4 is a left side elevational view.
Figure 5:
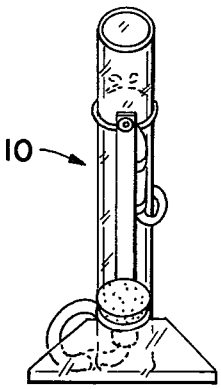
FIG. 5 is a rear elevational view.

FIGS. 3, 4 and 5 show the compactness of the unit combined with especially long-path provisions for smoke passage.

OPERATION

Figure 6:
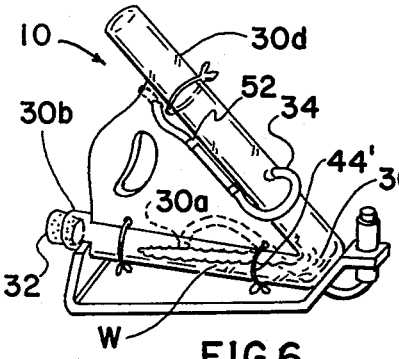
FIGS. 6, 7 and 8 are right side perspective views of successive positions of operation.

FIG. 6 shows the unit 10 with water W inside, ready for use. Water and ice may be introduced through either the cleanout plug end in the first or lower leg **30*b* or through the mouthpiece end in the second or upper leg 30*d*, or both. Fill level is indicated by the tie 44'** in the lower leg proximate the apex. When the "V" configuration is held upright for filling, the water level should rise to this tie.

With this load of water, the user can tip the unit back, raising the apex, until the water clears the throat or constriction **30*e* at the apex, and use the pipe as a conventional pipe, the water pooling at the plug 32 but not rising to the level of the smoke intake aperture 30*a***.

Also, with this load of water, the user can tip the unit forward, pooling more of the water at the apex, and increase the amount of water through which the smoke must travel, without getting water into the purge-tube 34.

Apparent in this Figure are metal clips 52 securing the purge-tube to the brace.

Figure 7:
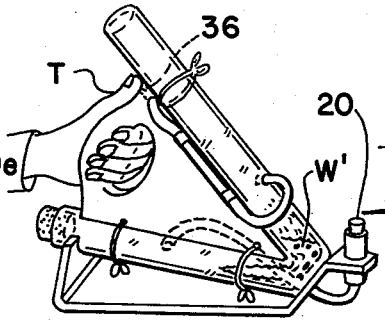

FIG. 7 shows the head of water W' raised into the second leg by normal operation, suction at the mouthpiece and thumb T on purge vent 36. Smoke from an ignited charge in the bowl 20 passes through the smoke tube and forces the water in the lower leg of the "V" or first tube, upward to a point at which the water cannot plug all the throat.

Figure 8:
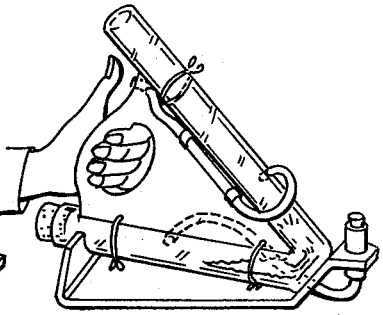

FIG. 8 indicates that at that point violent turbulence takes place, the smoke passing in numbers of erratically surging bubbles, spattering water in all directions. When the user observes the upper tube fill with smoke, the thumb is removed, the head of water collapses, and cooled smoke air-mixed and pressure-released by the purge-tube may be inhaled from the second tube. Slight tangential input at this point improves flow.

It will be noted from the above that a novel, substantially improved water pipe has been provided in an economical manner, the combination of stored-energy by predrawing the water charge into a head followed by turbulent automatic release and mixing not being known to have been provided in the prior art. Pop-out frictional retention and complete access at all ends for observation and cleaning are evident, as are versatility and simplicity in the several modes of use.

This invention is not to be construed as limited to the particular forms disclosed herein, since these are to be regarded as illustrative rather than restrictive. It is, therefore, to be understood that the invention may be practiced within the scope of the claim otherwise than as specifically described.

What is claimed and desired to be secured by U.S. Letters Patent is:

1. In a water pipe having means connecting together a bowl, a water container, a mouthpiece, purging means and a stand, the improvement comprising: the mouthpiece and water container comprising a tubular configuration in "V" shape with first and second legs and having a throat at the apex thereof, means for holding the "V" shape in predetermined attitude with the apex of the "V" shape down, means for closing an end of the first leg; said means for connecting including a connecting means tube from the bowl to an intermediate portion of the first leg, said purging means including a purging means tube having communication at a first end thereof with an intermediate portion of the second leg, a handle having attachment to the tubular configuration for manually holding the tubular configuration, and said purging means tube having a second end disposed proximate the handle in position adjacent the upper end of said second leg in position permitting manual closing and opening of the purging means from above said purging means tube connection with the intermediate portion of the second leg.

2. In a water pipe having means connecting together a bowl, a water container, a mouthpiece, purging means and a stand, the improvement comprising: the mouthpiece and water container comprising a tubular configuration in "V" shape with first and second legs and having a throat at the apex thereof, means for holding the "V" shape in predetermined attitude with the apex of the "V" shape down, means for closing an end of the first leg; said means for connecting including a connecting means tube from the bowl to an intermediate portion of the first leg, said purging means including a purging means tube having communication at a first end thereof with an intermediate portion of the second leg, a handle having attachment to the tubular configuration for manually holding the tubular configuration, said purging means tube having a second end disposed proximate the handle in position permitting manual closing and opening of the purging means tube second end, and the handle including a brace portion between said first and second legs and a grip, the second end of the purging means tube passing through the grip.

3. In a water pipe having means connecting together a bowl, a water container, a mouthpiece, purging means and a stand, the improvement comprising: the mouthpiece and water container comprising a tubular configuration in "V" shape with first and second legs and having a throat at the apex thereof, means for holding the "V" shape in predetermined attitude with the apex of the "V" shape down, means for closing an end of the first leg; said means for connecting including a connecting means tube from the bowl to an intermediate portion of the first leg, said purging means including a purging means tube having communication at a first end thereof with an intermediate portion of the second leg, a handle having attachment to the tubular configuration for manually holding the tubular configuration, said purging means tube having a second end disposed proximate the handle in position permitting manual closing and opening of the purging means tube second end, and the intermediate portion of the first leg being an upper portion thereof.

4. In a water pipe having means connecting together a bowl, a water container, a mouthpiece, purging means and a stand, the improvement comprising: the mouthpiece and water container comprising a tubular configuration in "V" shape with first and second legs and having a throat at the apex thereof, means for holding the "V" shape in predetermined attitude with the apex of the "V" shape down, means for closing an end of the first leg; said means for connecting including a connecting means tube from the bowl to an intermediate portion of the first leg, said purging means including a purging means tube having communication at a first end thereof with an intermediate portion of the second leg, a handle having attachment to the tubular configuration for manually holding the tubular configuration, said purging means tube having a second end disposed proximate the handle in position permitting manual closing and opening of the purging means tube second end, and the means for holding including said stand, the stand having forward end and rear end and an upturn at each end, the rear upturn forming a saddle for supporting the first leg at one end of the stand, the forward up turn forming a slope for supporting the apex of said "V" shape and further a slope for supporting the bowl.

5. In a water pipe having means connecting together a bowl, a water container, a mouthpiece, purging means and a stand, the improvement comprising the mouthpiece and water container comprising a tubular configuration in "V" shape with first and second legs and having a throat at the apex thereof, means for holding the "V" shape in predetermined attitude with the apex of the "V" shape down, means for closing an end of the first leg; said means for connecting including a connecting means tube from the bowl to an intermediate portion of the first leg, said purging means including a purging means tube having communication at a first end thereof with an intermediate portion of the second leg, a handle having attachment to the tubular configuration for manually holding the tubular configuration, said purging means tube having a second end disposed proximate the handle in position permitting manual closing and opening of the purging means tube second end, and the throat having a lesser capacity for passage of fluid than the portions of the first and second legs adjacent thereto.

6. In a water pipe as recited in claim 5, said lesser capacity resulting from structure including a crimp in the interior of the "V" shape protrusive toward the apex thereof.

7. In a water pipe as recited in claim 5, the means for closing comprising a detachable member.

8. In a water pipe as recited in claim 7, means for indicating water fill level, comprising a said handle attachment and said first leg adjacent thereto having at least a transparent portion.

9. In a water pipe as recited in claim 8, said tube from the bowl to an intermediate portion of the first leg having frictional, disconnectable connection to the bowl and to the first leg.

10. In a water pipe as recited in claim 9, the purging means tube communication at the first end thereof being a disconnectable friction connection.

11. In a water pipe having means connecting together a bowl, a water container, a mouthpiece, purging means and a stand, the improvement comprising: the mouthpiece and water container comprising a tubular configuration in "V" shape, with first and second legs and having a throat at the apex thereof, means for holding the "V" shape in predetermined attitude with the apex of the "V" shape down, means for closing an end of the first leg; said means for connecting including a connecting means tube from the bowl to an intermediate portion of the first leg, said purging means including a purging means tube having communication at a first end thereof with an intermediate portion of the second leg, a handle having attachment to the tubular configuration for manually holding the tubular configuration, said purging means tube having a second end disposed proximate the handle in position permitting manual closing and opening of the purging means tube second end, said handle attachment including the handle having a "V" shaped brace portion between the first leg and the second leg, means for yieldingly seating the handle to the "V" shaped brace portion, and means for tying the "V" shaped brace portion to all said first and second legs.

* * * * *